US007431602B2

(12) United States Patent
Corona

(10) Patent No.: US 7,431,602 B2
(45) Date of Patent: Oct. 7, 2008

(54) ELECTRICAL CONNECTOR

(75) Inventor: Sergio Corona, Upland, CA (US)

(73) Assignee: DSM & T Co., Inc., Fontana, CA (US)

( * ) Notice: Subject to any disclaimer, the term of this patent is extended or adjusted under 35 U.S.C. 154(b) by 454 days.

(21) Appl. No.: 10/907,937

(22) Filed: Apr. 21, 2005

(65) Prior Publication Data

US 2006/0237965 A1 Oct. 26, 2006

(51) Int. Cl.
*H01R 13/28* (2006.01)

(52) U.S. Cl. ..... 439/272; 439/281

(58) Field of Classification Search ..... 439/271–277, 439/281, 610

See application file for complete search history.

(56) References Cited

U.S. PATENT DOCUMENTS

| | | | | |
|---|---|---|---|---|
| 2,547,318 | A | 4/1951 | Harding | |
| 2,858,358 | A | 10/1958 | Hawke | |
| 3,761,867 | A * | 9/1973 | Churla | 439/413 |
| 3,796,504 | A | 3/1974 | Marechal | |
| 3,895,832 | A | 7/1975 | Ellis | |
| 3,956,575 | A | 5/1976 | Sutherland | |
| 3,971,614 | A * | 7/1976 | Paoli et al. | 439/321 |
| 4,145,075 | A | 3/1979 | Holzmann | |
| 4,250,348 | A | 2/1981 | Kitagawa | |
| 4,350,840 | A | 9/1982 | Michaels | |
| 4,358,079 | A | 11/1982 | Navarro | |
| 4,513,172 | A | 4/1985 | Matsui | |
| 4,571,018 | A | 2/1986 | Annoot | |
| 4,590,329 | A | 5/1986 | Potochnik et al. | |
| 4,600,803 | A | 7/1986 | Holzmann | |
| 4,767,135 | A | 8/1988 | Holzmann | |
| 4,787,657 | A | 11/1988 | Henniger | |
| 5,048,872 | A | 9/1991 | Gehring | |
| 5,112,245 | A * | 5/1992 | Shimirak et al. | 439/412 |
| 5,200,575 | A * | 4/1993 | Sheehan | 174/654 |
| 5,405,172 | A | 4/1995 | Mullen | |
| 6,069,320 | A | 5/2000 | Rocci et al. | |
| 6,123,563 | A * | 9/2000 | Johnson et al. | 439/321 |
| 6,162,095 | A * | 12/2000 | Holman | 439/610 |
| 6,294,740 | B1 * | 9/2001 | Van Swearingen | 174/151 |
| 6,375,509 | B2 * | 4/2002 | Mountford | 439/610 |
| 6,444,914 | B1 | 9/2002 | Su | |

* cited by examiner

*Primary Examiner*—Briggitte R Hammond
(74) *Attorney, Agent, or Firm*—Collard & Roe, P.C.

(57) ABSTRACT

An electrical connector device can be formed to be substantially fluid tight. This device can comprise a body having teeth and an optional insert having two sides with at least two sets of teeth wherein a first set of teeth is disposed on a first side of the insert, and a second set of teeth are disposed on a second side of the insert. The first set of teeth are for mating with the teeth on the body to form a substantially sealed connection between the insert and the body. There can also be a sealing nut for securing over the insert and the body, wherein the sealing nut includes a set of teeth wherein when the sealing nut is screwed down onto the body, the set of teeth on the sealing nut mate with the second set of teeth on the insert to form a substantially sealed connection between the sealing nut and the insert. The spacer then keeps each of these soldered wires separate from each other. In this case, the soldered connection can be used to prevent the wicking of fluid inside of the connection, and also the cavity is filled with a sealant so that if fluid or any other fluid enters into this connection, it does not flow to either side of the soldered point.

12 Claims, 8 Drawing Sheets

ELECTRICAL CONNECTOR

BACKGROUND OF THE INVENTION

The present invention relates to a sealing lock for an electrical connector. In this case the sealing lock can be in the form of a lock to create an air-tight and more importantly a fluid-tight connection.

The References

Other types of sealing locks are known in the art. For example, sealing locks for electrical connectors may be disclosed in the following U.S. patents: U.S. Pat. No. 6,444,914 to Su issued on Sep. 3, 2002; U.S. Pat. No. 6,069,320 to Rocci et al issued on May 30, 2000; U.S. Pat. No. 4,571,018 to Annoot issued on Feb. 18, 1986; U.S. Pat. No. 4,590,329 to Potochnik et al issued on May 20, 1986; U.S. Pat. No. 3,956,575 to Sutherland issued on May 11, 1976; and U.S. Pat. No. 2,858,358 to Hawke issued on Oct. 28, 1958 wherein the disclosures of which are hereby incorporated herein by reference.

SUMMARY OF THE INVENTION

The invention relates to an electrical connector device comprising a body having teeth. There can also be an insert having two sides and at least two sets of teeth wherein a first set of teeth are disposed on a first side of the insert and a second set of teeth are disposed on a second side of the insert. The first set of teeth are for mating with the teeth on the body to form a substantially sealed connection between the insert and the body. There can be a sealing nut for securing over the insert and the body; the sealing nut may include a set of teeth and the sealing nut is screwed down onto the body. The set of teeth on the sealing nut may mate with the second set of teeth on the insert to form a substantially sealed connection between the sealing nut and the insert.

In this case, there can be a body that further comprises a plurality of threads. With this design, the sealing nut can further comprise a plurality of threads, wherein the sealing nut can be screwed on over the body via the threads. This device can also optionally further comprise a sealing gland. In one embodiment, the sealing gland can be coupled to the body between the insert and the sealing nut.

There can also be a spacer disposed inside of the body for spacing at least two wires apart from each other in the housing.

In one optional feature, the spacer can be in the form of a multi-pronged element having at least one channel disposed between at least two of these prongs.

Another optional feature is that the insert can comprise at least four sets of teeth, with at least two sets of teeth disposed on a first side, and at least two sets of teeth disposed on an opposite side of this insert.

Alternatively, this insert can comprise at least six sets of teeth, with at least three sets of teeth disposed on a first side and at least three sets of teeth disposed on an opposite side of this insert.

Once the sealing nut is screwed down on the body, the teeth from the sealing nut can mesh with the teeth on one side of the insert, while the teeth on the other side of the insert mesh with a set of teeth on the body to form a sealed connection. Before, during, or after this process occurs, the back open end of the connection opposite from the sealing nut can be filled with an epoxy element to fill a chamber inside of the body to form a sealed end.

One of the benefits of this device is that it creates a sealed connection between a plurality of wires so that these wires do not short out when they become wet, in addition, this device is designed to allow migration in either direction. The sealed connection can be created from the teeth meshing together to form a sealed enclosure.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
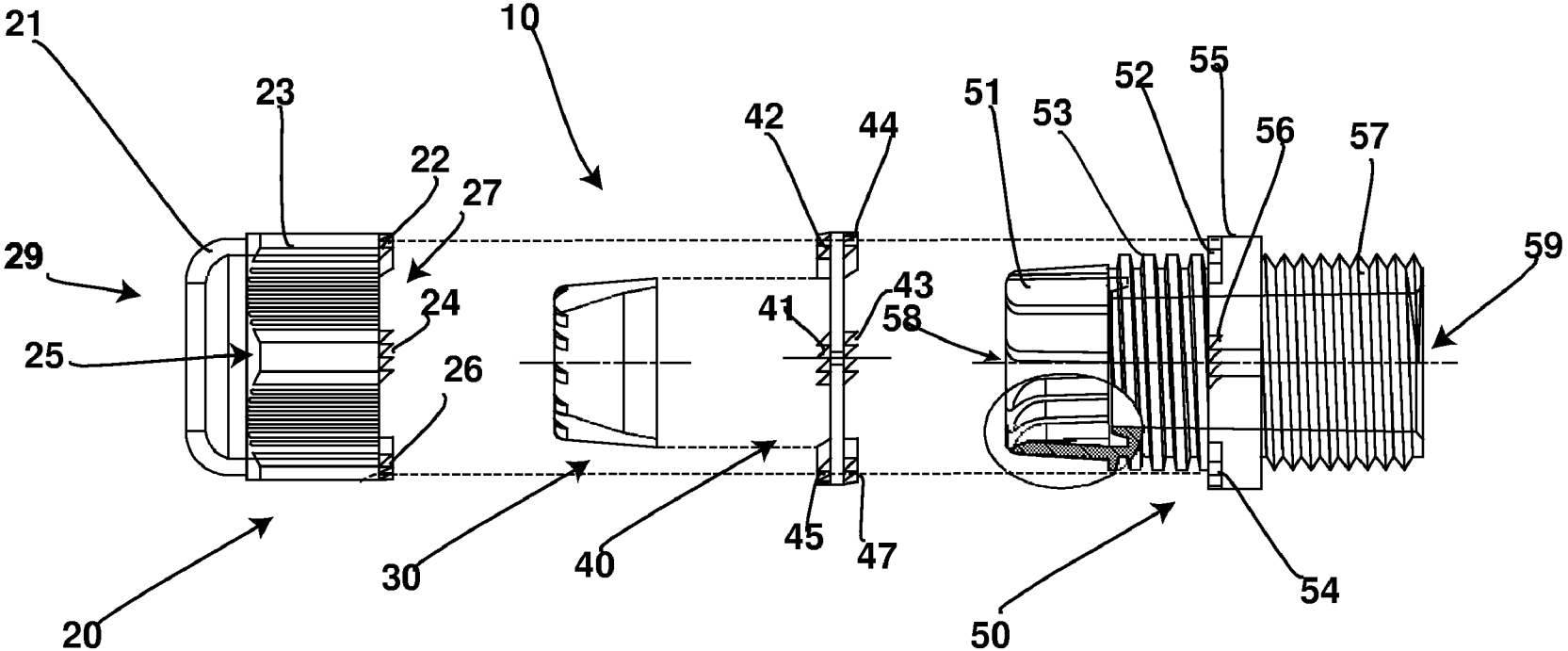
FIG. 1 is a side exploded view of the sealing connection.

Turning now in detail to the drawings, FIG. 1 is a side exploded view of the sealing connection for a plurality of wires to turn a plurality of wires into a single wire connection or into a connection of three wires into a single sheath.

In this case, there is the device 10 which includes a sealing nut 20, a sealing gland 30, an insert 40, and a body 50 wherein these components can all be fit together to for a fluid tight seal such as a fluid tight seal.

With this design, the sealing nut can be in the form of a substantially cylindrical sealing nut having a curved top 21, a hollowed center 25, a side wall having ridges 23, and at least three sets of teeth 22, 24, and 26 disposed around a back face 27. There is also a front face 29 which is open at its end to allow the hollowed center to extend from the back face 27 to the front face 29.

There is also a sealing gland 30 which can be in the form of a flexible device which fits underneath sealing nut 20. Sealing gland 30 is shown in greater detail in FIGS. 3A, 3B, and 3C. Disposed adjacent to sealing gland 30 is an insert 40 which can include a hollow center and a plurality of teeth disposed on either side of this insert. In this case, there can be many different sets of teeth 41, 42, 43, 44, 45, and 47 disposed on either side of insert 40. The teeth 41, 42, and 45 can be used to interact with teeth 22, 24, 26 on sealing nut 20 to form a non-retractable sealed connection.

Figure 2A:
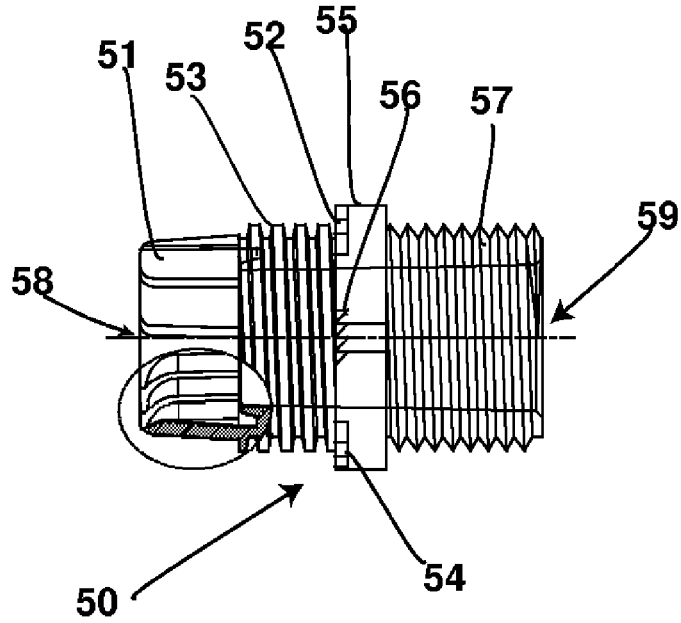
FIG. 2A shows a side view of the body shown in FIG. 1.
Figure 2B:
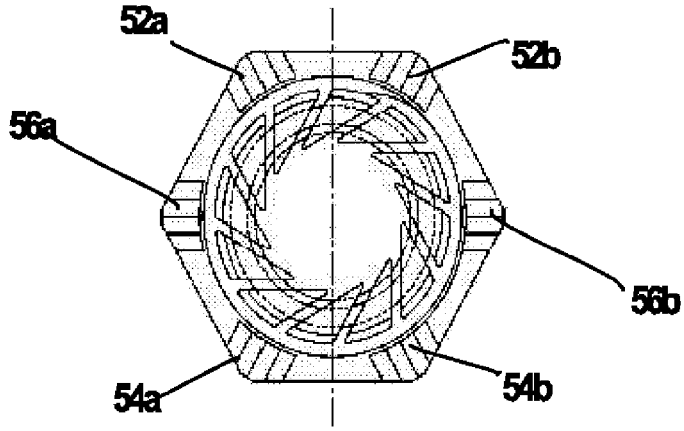
FIG. 2B shows a front end view of the body shown in FIG. 1 and FIG. 2A.
Figure 2C:
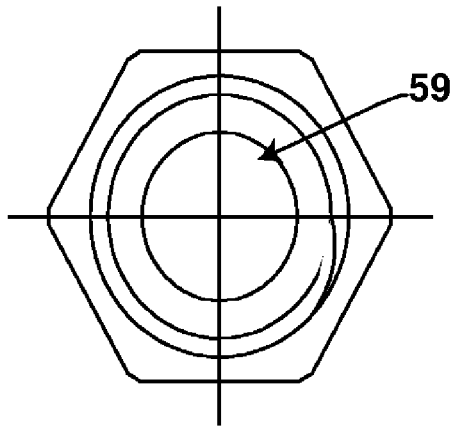
FIG. 2C shows a back end view of the body shown in FIG. 1 and in FIG. 2A.

Finally, there is a connection body or body 50 which is shown in greater detail in FIGS. 2A, 2B, and 2C. Body 50 can include a front or first end 51, a first threaded region 53, a middle nut region 55, a plurality of teeth 52, 54, 56 disposed on a face of the middle nut region. There can also be a second threaded region 57 which is disposed on the opposite side of nut region 55 from first threaded region 53. This sealing nut includes open ends 58 and 59 with a first open end 58 facing towards insert 40 and a second end 59 facing in the opposite direction. There is also a hollow center channel (See FIGS. 2B and 2C) that runs throughout body 50 from first end 58 to second or back end 59 wherein this channel forms a receiving conduit for receiving connecting wires.

FIG. 2B shows a front face as shown in FIG. 2A as number 58, wherein this front face 58 includes 6 (six) different sets of teeth which can be used to form a non-reversible sealing elements. The different sets of teeth are 52*a*, 52*b*, 54*a*, 54*b*, 56*a*, and 56*b* and can include at least one or even more than one tooth in each set. FIG. 2C shows the threaded back end 59 of body 50.

Figure 3C:
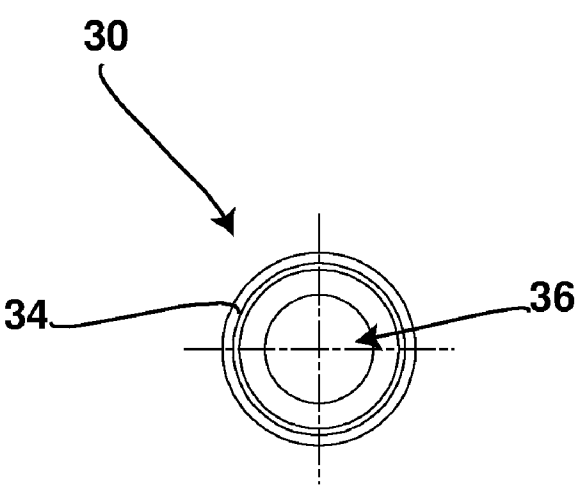
FIG. 3C shows a back end view of the sealing gland shown in FIG. 3A and in FIG. 1.
Figure 3B:
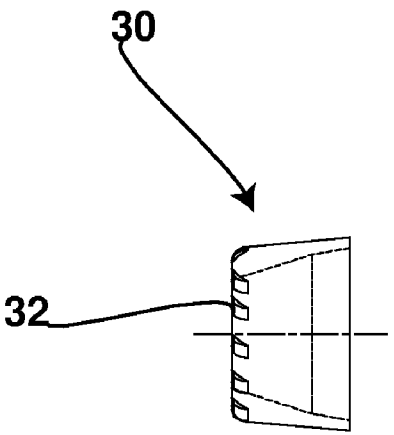
FIG. 3B shows a side view of the sealing gland shown in FIG. 1.
Figure 3A:
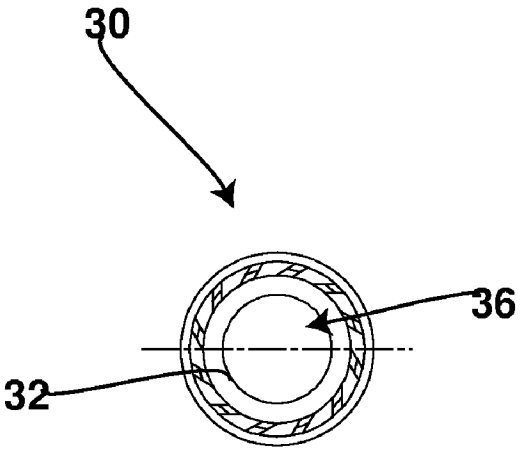
FIG. 3A shows a front end view of the sealing gland shown in FIG. 1.

FIG. 3A shows a front end view of the sealing gland 30 shown in FIG. 1. This front end view shows an open channel 36 for receiving wires passing therethrough. In addition, this sealing gland 30 can also include at least a partially closed top end 32 which is narrowed down in a frusto-conical manner as shown in FIG. 3B. FIG. 3C shows a back end 34 of sealing gland 30 which shows the open channel 36 for allowing wires to pass therethrough.

Figure 4C:
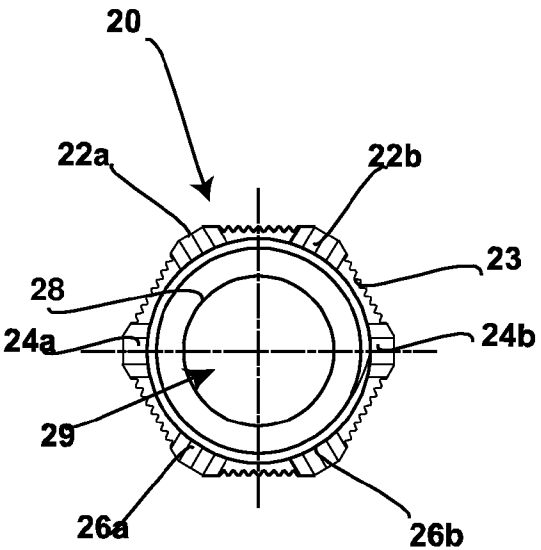
FIG. 4C shows a back end view of the sealing nut shown in FIG. 4A and in FIG. 1.
Figure 4B:
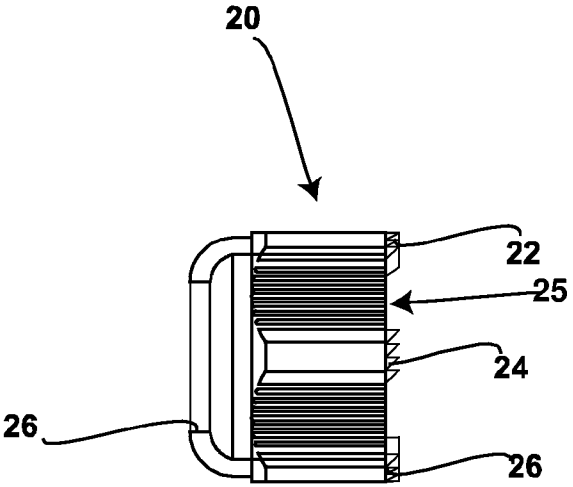
FIG. 4B shows a side view of the sealing nut shown in FIG. 4A and in FIG. 1.
Figure 4A:
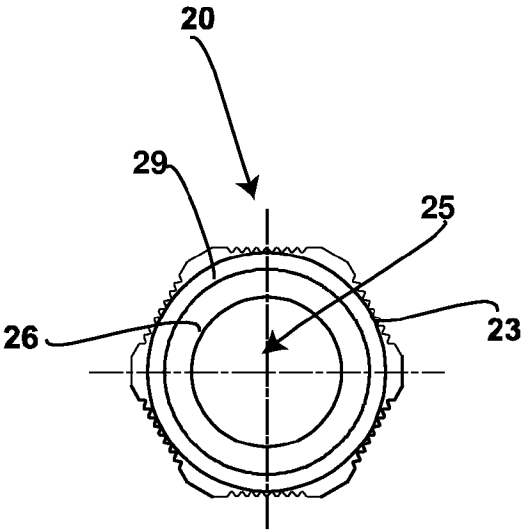
FIG. 4A shows a front end view of the sealing nut shown in FIG. 1.

FIG. 4A shows a front end view of sealing nut 20 shown in FIG. 1. This sealing nut can have a corrugated or roughened edge 23 which can be used to allow a user to grip tighten the device onto body 50. Front end 49 has a narrowed or tapered end in the form of a curved top 21 which can be used to close in around a set of wires. There are a plurality of teeth or sealing elements 22, 24, and 26 shown on a back face 47. FIG. 4C shows a view of back face 45 wherein there is shown an inner edge 48 of an inner conduit 49 for receiving wires or one main wire. This view shows the different sets of teeth 42*a*, 42*b*, 44*a*, 44*b*, 46*a*, 46*b* all dispersed around the periphery of this nut.

Figure 5C:
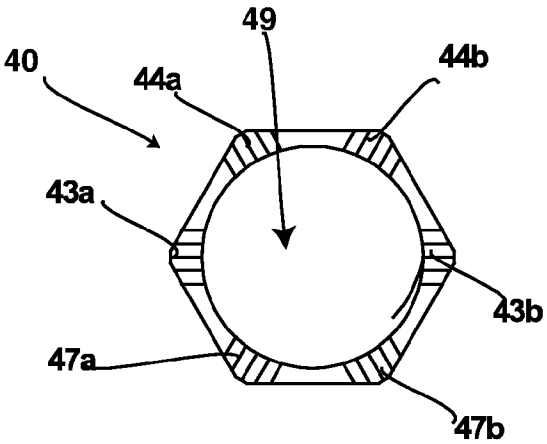
FIG. 5C shows a back end view of the insert shown in FIG. 1 and in FIG. 5A.
Figure 5B:
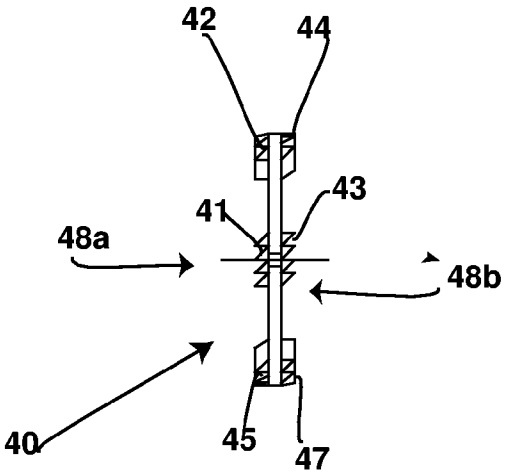
FIG. 5B shows a side view of the insert shown in FIG. 1 and in FIG. 5A.
Figure 5A:
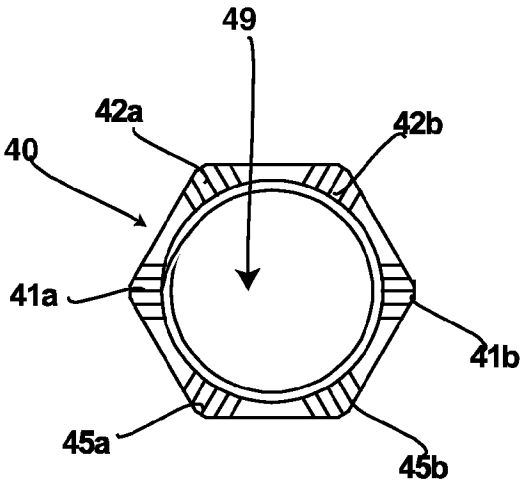
FIG. 5A shows a front end view of the insert shown in FIG. 1.

FIG. 5A shows a front end view of the insert 40 shown in FIG. 1. In this case, insert 40 can include a plurality of different sets of teeth disposed both on a front face 48*a* and a back face 48*b* as shown also in FIG. 5B. In addition, this view along with FIG. 5C also shows conduit or passage 49 which can be used to allow wires to pass therethrough. On face 48*a*, there are six different sets of teeth 41*a*, 41*b*, 42*a*, 42*b*, 45*a*, 45*b* which can be used to interact with teeth disposed on sealing nut 20. Alternatively FIG. 5C shows the opposite face 48*b* which shows six different sets of teeth including sets 43*a*, 43*b*, 44*a*, 44*b*, 47*a*, 47*b* disposed around a peripheral region of this insert. This opposite face 48*b* can face body 50 so that teeth 43*a*, 43*b*, 44*a*, 44*b*, 47*a*, and 47*b* can be used to mesh with any one of teeth 52*a*, 52*b*, 54*a*, 54*b*, 56*a*, 56*b* in any order to form a sealing connection between insert 40 and body 50.

Figure 6A:
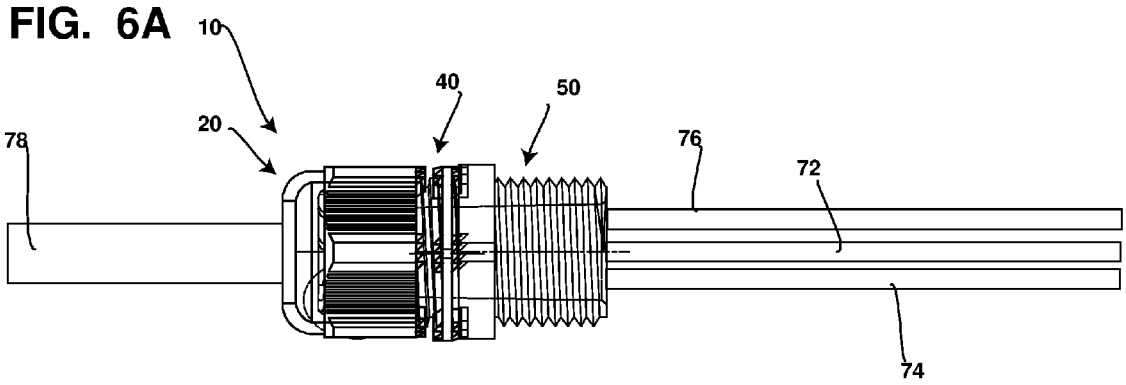
FIG. 6A shows a side view of a sealed version of the device shown in FIG. 1.

FIG. 6A shows a side view of an assembled and therefore substantially sealed version of the device shown in FIG. 1. In this view a plurality of wires 72, 74, and 76 are inserted into body 50, insert 40, sealing gland 30, and sealing nut 20 so that these wires run through the central channel and are sealed therein. These three wires are then coupled together to form a single wire conduit or three separate wires in a single sheath 78. The wires may be electrically coupled together in any known manner such as through welding, soldering or for example through mechanical connection.

Figure 6B:
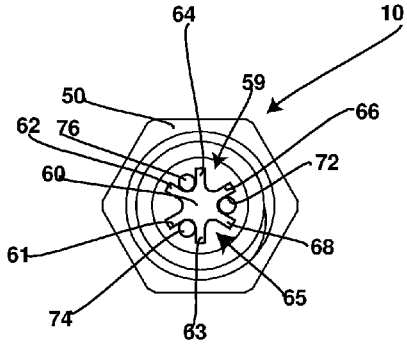
FIG. 6B shows as back end cross-sectional view of the device shown in FIG. 1 in a sealed condition with a spacer inserted therein.

FIG. 6B shows as back end cross-sectional view of the device shown in FIG. 1 in a sealed condition with a spacer inserted therein. In this view there is a spacer 60 which can be used to space the three wires 72, 74, 76 apart from each other. The spacer 60 can include legs 61, 62, 63, 64, 66, 68, wherein each of these legs can extend out from a central region to form a channel 65 for one or more of the wires until these wires join a single sheath 78 as shown in greater detail in FIGS. 7A and 7B.

Figure 7A:
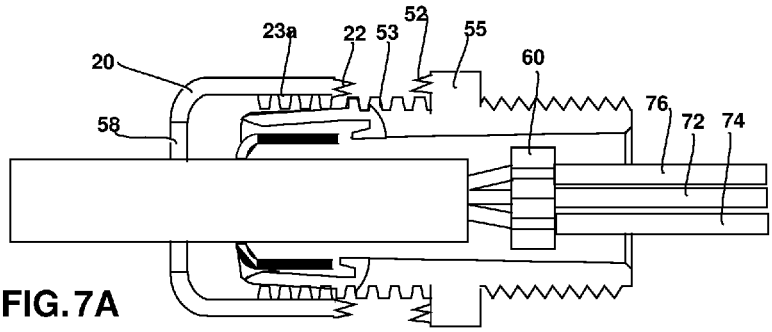
FIG. 7A shows a side cross-sectional view of another embodiment of the device being set in a first unsealed condition and moving toward a sealed state.
Figure 7B:
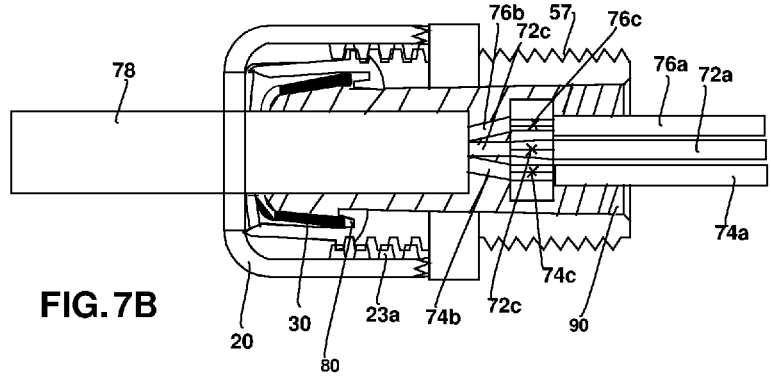
FIG. 7B shows a side cross-sectional view of the embodiment of the device shown in FIG. 7A in a sealed state.

FIG. 7A shows a side cross-sectional view of another embodiment of the device being set in a first unsealed condition and moving toward a sealed state in FIG. 7B. In this embodiment, there is shown the sealing system without an insert 40 disposed therein. Nut 20 is then screwed onto body 50 via threads 23*a* on nut 20 meshing with threads 53 on body 50. In this view, the three wires 72, 74, and 76 are fed into spacer or spreader 60 which then controls the spacing of these wires wherein these wires then extend into the single sheath 78. These three wires 72, 74, 76 are essentially two separate wires 72*a*, 72*b*, 74*a*, 74*b* and 76*a*, 76*b* joined at the spacer via soldering at soldering points 72*c*, 74*c*, 76*c* respectively. The spacer 60 then keeps each of these soldered wires separate from each other. In this case, the soldered connection can be used to prevent the wicking of fluid inside of the connection so that if fluid or any other fluid enters into this connection, it does not flow to either side of the soldered point.

The device is sealed so that as nut 20 is screwed down on body 50, sealing gland 30 is compressed and then expands laterally out as shown in FIG. 7B so that gland or gasket 30 contacts or slides into notch 80 to form a secure seal. In addition, in this case, sealing gland 30 also forms a secure connection against sheath 78 as it is compressed down by nut 20 to form a substantially fluid tight seal. A substantially fluid or gel like material such as an epoxy or any other known sealant 90 can be injected into a back end of body 50 to seal the back end of body 50. This sealant can extend from the open end to the opposite end which is closed by the gland or gasket 30.

Figure 8:
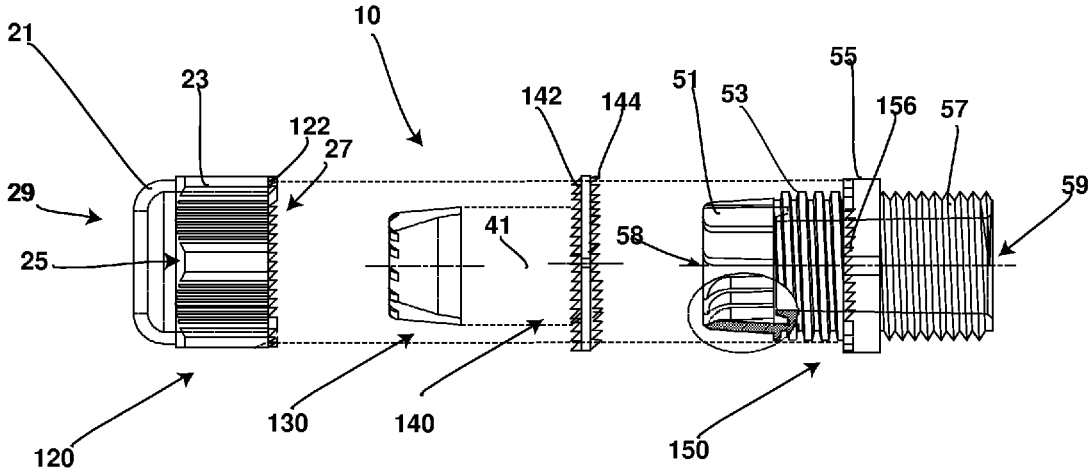
FIG. 8 shows a side exploded view of an alternative embodiment of the sealing connection.

FIG. 8 shows a side exploded view of an alternative embodiment of the sealing connection. In this embodiment the teeth extend all the way around or substantially all the way around each of the peripheral radial edges of each of the connections. In this embodiment, a different sealing nut 120 can have a set of teeth 122 extending substantially around an entire peripheral edge of this sealing nut 120. In addition, in this embodiment both sides of insert 140 would include a set of teeth 142, 144 which extend substantially or entirely around the peripheral edge of this insert. Body 150 would also include a set of one or more teeth 156 that would extend substantially or entirely around the peripheral edge of the body. With this design, the teeth or sets of teeth on sealing nut 120, insert 140 and body 150 would not have to be lined up for there to be a sealing lock. Because in this embodiment the teeth extend substantially or entirely around the peripheral region of these elements, as nut 120 is screwed down onto body 150, these teeth mesh together to form a fluid tight seal.

Figure 9:
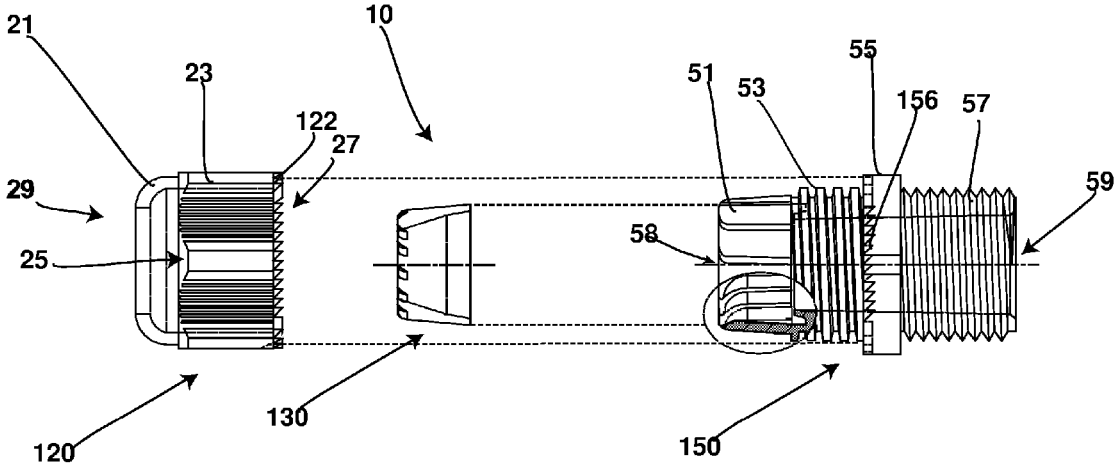
FIG. 9 is a side exploded view of another embodiment of the invention.

Alternatively, FIG. 9 shows a side exploded view of another embodiment of the invention, wherein the insert shown in FIG. 8 is not used. Instead, the sealing nut 20 is sealed against body 50 via teeth 122 and 156 meshing together once sealing nut 20 is screwed onto body 50.

Thus, the device in its at least two embodiments can be used to form a fluid tight seal at both ends so that no fluid or substantially no fluid enters the connection to short out the connection. This type of device has numerous advantages based upon its features. For example, the epoxy or sealant element 90 can be used to prevent fluid such as fluid from wicking in or entering into the connection from a region outside of the wires.

Alternatively, the soldering point in the soldered joint 72*c*, 74*c*, 76*c* can be used to stop the wicking or flow of fluid into the joint or across the joint from inside of the shielded cable. For example if outside of this connection element or device, a shielding of the cable is punctured, fluid or other fluid can wick or flow inside of this connection and cross over an unsoldered connection into an electrical device. However, because of soldering connections 72*c*, 74*c*, and 76*c* at spreader 60, the lump or protrusion formed from the solder, stops the flow of fluid from progressing inside of this connection.

In addition, the teeth of this device can be designed so that as nut 20, 120 is screwed down on either insert 40, 140 or alternatively body 50, 150 these teeth slide over each other in the tightening rotational movement, but once nut 20, 120 has been tightened, these teeth on nut 20, 120 lock with the teeth on insert 40, 140 in the first embodiment. In this embodiment as well, the teeth of insert 40, 140 also lock against body 50, 150 so that during the tightening phase, the teeth points are pointing away from the direction of rotation but once the device is tightened, these teeth points lock into recesses formed from the opposite complementary teeth on body 50, 150 so that during an un-tightening phase, the teeth points lock into the corresponding recesses to cause a lock of the nut. Alternatively, in another embodiment, the teeth from nut 20, 120 can lock directly with the teeth on body 50, 150 so that nut 20, 120 cannot be unscrewed from its tightened condition without breaking the teeth and/or the nut or body.

In addition, a method to prevent the wicking of fluid in an electrical connection has also been disclosed. For example, this method can include, first the soldering or electrical connection of at least two wires adjacent to a spacer 60 which is positioned inside of a body. Next, an optional insert can be slid down adjacent to this body 50, 150. A Sealing gland or gasket 30, 130 can be placed over or adjacent to this insert 40, 140 while a threaded nut 20, 120 is screwed down onto body 50, 150 to compress sealing gland 30, and to press insert 40, 140 into both nut 20, 120 and body 50, 150. As threaded nut 20, 120 is tightened down, the teeth points on for example, teeth 142 associated with nut 120, point in a direction opposite of rotation of nut 120 as it is being tightened. However, the corresponding or complementary teeth points of optional insert 140 in the form of for example, teeth 142 are pointed in the direction of rotation nut 120. Thus, teeth 122 slide over teeth 142 as nut 120 is being tightened down. Once nut 120 is fully tightened, teeth 122 lock with teeth 142 so that teeth points on teeth 122 dig into teeth 142 so that a user cannot untighten or counter rotate nut 120 from insert 140 without breaking either the teeth or the entire element. Additionally, as nut 120 is being tightened down, insert 140, having oppositely spaced teeth 144 locks into body 150. For example, teeth 144 has teeth points which point in a direction opposite of the direction of rotation of insert 140 as nut 120 is being tightened down on body 150. In addition, body 150 has teeth 156 which have teeth points which point in the direction of rotation of insert 140 as nut 120 is being tightened down. Teeth 144 therefore slide over teeth 156 during the tightening stage. However as described above, once nut 120 is fully tightened, teeth 144 lock into teeth 156 with the teeth points locking the teeth against an untightening or counter rotation. This feature then causes the entire device to be locked against an untightening rotation which may result in an unfortunate opening in the connection. Therefore this design prevents this occurrence.

Next, an epoxy or any other known sealant material is injected or inserted into an open end of body 50, which forms an open connection end. This epoxy can be inserted into open end 59 and extend all the way up to opposite open end 58 to form an entirely sealed container. Once the epoxy hardens, the entire device is substantially or entirely sealed against wicking, leakage, or seepage of fluid into the connection.

Accordingly, while a few embodiments of the present invention have been shown and described, it is to be understood that many changes and modifications may be made thereunto without departing from the spirit and scope of the invention as defined in the appended claims.

What is claimed is:

1. An electrical connector device comprising:

a) a body having teeth;

b) an insert having two sides and at least two sets of teeth wherein a first set of teeth is disposed on a first side of said insert and a second set of teeth is disposed on a second side of said insert, wherein said first set of teeth is for mating with said teeth on said body to form a substantially sealed connection between said insert and said body; and c) a sealing nut for securing over said insert and said body, wherein said sealing nut includes at least one set of teeth wherein when said sealing nut is screwed down onto said body, said set of teeth on said sealing nut mate with said second set of teeth on said insert to form a substantially sealed connection between said sealing nut and said insert; and d) a spacer disposed inside of said body for spacing at least two wires apart from each other in said housing, wherein said spacer is a multi-pronged element having at least one channel disposed between at least two of said prongs.

2. The device as in claim 1, wherein said body further comprises a plurality of threads, and wherein said sealing nut further comprises a plurality of threads, wherein said sealing nut can be screwed on over said body via said threads.

3. The device as in claim 1, further comprising a sealing gland.

4. The device as in claim 3, wherein said sealing gland can be coupled to said body between said insert and said sealing nut.

5. An electrical connector device comprising:

a) a body having teeth;

b) an insert having at least four sets of teeth, with at least two sets of teeth disposed on a first side and at least two sets of teeth disposed on an opposite side of said insert wherein a first set of teeth of said at least four set of teeth is for mating with said teeth on said body to form a substantially sealed connection between said insert and said body; and c) a sealing nut for securing over said insert and said body, wherein said sealing nut includes at least one set of teeth wherein when said sealing nut is screwed down onto said body, wherein said at least one set of teeth on said sealing nut mate with a second set of teeth of said at least four set of teeth on said insert to form a substantially sealed connection between said sealing nut and said insert.

6. An electrical connector device comprising:

a) a body having teeth;

b) an insert having at least six sets of teeth, with at least three sets of teeth disposed on a first side and at least three sets of teeth disposed on an opposite side of said insert wherein a first set of teeth of said at least six set of teeth is for mating with said teeth on said body to form a substantially sealed connection between said insert and said body; and c) a sealing nut for securing over said insert and said body, wherein said sealing nut includes at least one set of teeth wherein when said sealing nut is screwed down onto said body, a set of teeth of said at least one set of teeth on said sealing nut mate with a second set of teeth of said at least six set of teeth on said insert to form a substantially sealed connection between said sealing nut and said insert.

7. A process for sealing an electrical connection comprising the following steps:

inserting a plurality of wires into a body having threads and teeth;

placing an insert over said plurality of wires and adjacent to said body wherein said insert has at least two opposite sides and has teeth on both of said at least two opposite sides;

inserting a spacer into said body to space said plurality of wires apart in a region where said plurality of wires are connected together, joining a first set of wires of said plurality of wires with a second set of wires at a plurality of solder points wherein said plurality of solder points are disposed adjacent to said spacer; and placing a sealing nut over said plurality of wires wherein said sealing nut has threads and a plurality of teeth and wherein said sealing nut is threaded onto said body threads and wherein when said sealing nut is screwed onto said body via said threads, said teeth from said sealing nut mesh with said teeth from said body to form a fluid tight seal.

8. The process as in claim 7, further comprising the step of inserting a substantially fluid like seal into said body to seal a back end of said body against a wire connection.

9. The process as in claim 7, further comprising inserting a sealing gland over said plurality of wires and between said body and said sealing nut, wherein when said sealing nut is tightened over said body, said sealing nut compresses against said sealing gland to compress said sealing gland onto said plurality of wires to form a fluid tight connection.

10. An electrical connector device for forming a substantially fluid tight seal around an electrical connection of a plurality of wires, the electrical connector device comprising:

a) a body having teeth; and b) a sealing nut for securing over said body, wherein said sealing nut includes at least one set of teeth wherein when said sealing nut is screwed down onto said body, a set of teeth of said at least one set of teeth on said sealing nut mate with said teeth on said body to form a substantially sealed connection between said sealing nut and said insert;

c) a spacer for spacing the plurality of wires being connected in the connector apart;

d) a solder point formed at said spacer, wherein the plurality of wires are joined together at said spacer to form said solder point.

11. The device as in claim 10, wherein each solder point of said plurality of wires acts to prevent fluid migration from one side of each solder point to an opposite side of each solder point.

12. An electrical connector device for forming a substantially fluid tight seal around an electrical connection of a plurality of wires, the electrical connector device, comprising:

a) a body having teeth; and b) a sealing nut for securing over said body, wherein said sealing nut includes at least one set of teeth wherein when said sealing nut is screwed down onto said body, a set of teeth on said sealing nut mate with said teeth of said at least one set of teeth on said body to form a substantially sealed connection between said sealing nut and said insert;

wherein said sealing nut and said sealing body are joined together to form at least two end points for a connection and wherein the device further comprises a sealant which is disposed inside of said sealing nut and said sealing body to seal said at least two end points for said connection.

* * * * *